US007090159B2

(12) United States Patent
Condon et al.

(10) Patent No.: US 7,090,159 B2
(45) Date of Patent: Aug. 15, 2006

(54) INVERTIBLE CENTER FEED DISK FOR A VERTICAL SHAFT IMPACT CRUSHER

(75) Inventors: Gary J. Condon, Irwin, PA (US); Don C. Rowlett, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 193 days.

(21) Appl. No.: 10/806,855

(22) Filed: Mar. 23, 2004

(65) Prior Publication Data

US 2005/0211810 A1 Sep. 29, 2005

(51) Int. Cl.
*B02C 1/10* (2006.01)
*B02C 1/08* (2006.01)

(52) U.S. Cl. ..... 241/275; 241/278.1; 241/296

(58) Field of Classification Search ..... 241/275, 241/300, 278.1, 296; 415/121.1; 416/204 R, 416/244 R See application file for complete search history.

(56) References Cited

U.S. PATENT DOCUMENTS 3,174,698 A * 3/1965 Miller ..... 241/275
3,578,254 A * 5/1971 Wood ..... 241/275
3,652,023 A 3/1972 Wood
4,065,063 A * 12/1977 Johnson ..... 241/275
4,090,673 A * 5/1978 Ackers et al. ..... 241/275
4,126,280 A 11/1978 Burk
4,390,136 A * 6/1983 Burk ..... 241/275
4,690,341 A 9/1987 Hise et al.
4,921,173 A 5/1990 Bartley
5,029,761 A 7/1991 Bechler
5,318,231 A * 6/1994 Bernhardt et al. ..... 241/236
5,697,562 A * 12/1997 Leblond ..... 241/101.74
5,806,774 A 9/1998 Vis
5,863,006 A 1/1999 Thrasher
5,921,484 A 7/1999 Smith et al.
6,070,820 A 6/2000 Young et al.

* cited by examiner

*Primary Examiner*—Faye Francis
(74) *Attorney, Agent, or Firm*—Matthew W. Smith

(57) ABSTRACT

An impact crusher includes a center feed disk. The center feed disk includes a peripheral edge portion, a first face, an opposing, second face, a central bore extending through the first and second faces, and first and second countersunk pockets provided about the central bore in the first and second faces respectively. With this arrangement, a fastener having a shaft portion and a head portion can be inserted through the central bore to secure the center feed disk to a drive mechanism, with the head portion residing in the countersunk pocket. With this arrangement, once the first face portion becomes worn, the center feed disk can be removed, inverted and re-mounted such that the second face portion is exposed.

14 Claims, 3 Drawing Sheets

INVERTIBLE CENTER FEED DISK FOR A VERTICAL SHAFT IMPACT CRUSHER

BACKGROUND OF THE INVENTION

1. Field of the Invention

The present invention pertains to the art of impact crushers and, more particularly, to a center feed disk for an impact crusher that, after a first side surface has become worn, can be inverted to make use of an opposing, second side surface for operating the impact crusher.

2. Discussion of the Prior Art

There are a wide variety of impact crushers currently employed to reduce the size of large earth materials to smaller sized aggregate. Typically, a flow of large earth materials is dropped or fed onto a rotating feed disk that, using centrifugal force, disperses the large earth materials through the impact crusher onto crushing components. Generally, the crushing components include impeller shoes and anvils that are radially positioned about the feed disk. In any event, impact crushers reduce large aggregate earthen materials to aggregate sizes and shapes to meet the needs of, for example, the construction industry as ingredients for cement and the like.

The components of an impact crusher that are exposed to a material flow are subject to wear. The wear is essentially caused by abrasion, decomposition, fracture, impact, grinding and the like. In general, the wear results from the velocity, acceleration and composition of the material flow that is directed onto the components of the impact crusher. Over time, the wear reaches a point which mandates that one or more of the impact crusher components be replaced. One component that is prone to wear is the feed disk. A typical feed disk can process about 2,500 tons of material before becoming worn and in need of replacement. Thus, in an impact crusher that can process 42 tons of material an hour, the average life of a feed disk would be approximately 60 hours. Accordingly, every 60 hours or so, the feed disk must be replaced. As only one surface of the feed disk is usable, the costs associated with feed disk replacement are high.

Based on at least these reasons, there exists a need in the art for a feed disk that has a longer service life. More specifically, there exists a need in the art for a feed disk that can be inverted so that both surfaces of the disk can be used in operating the impact crusher before the disk is discarded.

SUMMARY OF THE INVENTION

The present invention is directed to a center feed disk and an impact crusher that are used to reduce the size of large earth materials to smaller sized aggregate. The impact crusher includes an impeller table assembly having a rotating impeller table. The impeller table includes an outer edge portion, as well as an inner edge portion that define an impeller surface. The impeller table assembly also includes a plurality of shoes that are arranged about the impeller surface. The shoes function to catch the large earth materials and throw them, with tremendous centrifugal force, radially outwardly against fixed anvils. Large earth materials are actually dropped onto a rotating, center feed disk that receives and directs the large earth materials toward the shoes and ultimately onto the anvils. Upon impacting the fixed anvils, the large earth materials break up, under their own momentum, into smaller aggregate material.

In accordance with the invention, the center feed disk includes a peripheral edge portion, a first face and an opposing, second face. A central bore extends through the first and second faces and is surrounded by first and second countersunk pockets provided in each of the first and second faces respectively. A fastener, having a shaft portion and a head portion, is inserted through the central bore to secure the center feed disk for rotation with the impeller table. Preferably, the fastener is sized such that, when fully engaged, the head portion is completely recessed within the countersunk pocket. Once the first face of the center feed disk exhibits sufficient wear, the center feed disk can be removed, inverted and re-mounted to the impeller table such that the second face is then used to receive and direct the large earth materials toward the shoes to be crushed into aggregate. In this manner, an overall service life of the center feed disk can be increased by as much as two times.

In further accordance with the invention, the center feed disk is formed from a wear-resistant material, such as a chromium iron (ASTM A532/A532M-93a standards) alloy or a carbide, preferably cemented tungsten carbide. Experience has shown that chromium, at levels of 23–30%, produces advantageous wear-resistant qualities. In addition, prior to inverting the center feed disk, smoothing and preferably improving the balancing of the disk may be employed. Because the disk rotates at high speeds, some as high as approximately 2000 rpm, an out-of-balance disk could cause substantial vibration. Thus, prior to re-mounting, the wear regions are preferably filled with a resin, such as liquid silicone, preferably a high density material similar to LAB/metal™ or having greater density to provide a uniform surface in the event of uneven wear, and preferably substantially minimize, an out-of-balance condition. LAB/metal™ is marketed by Alvin Products Inc., of Lawrence, Mass.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
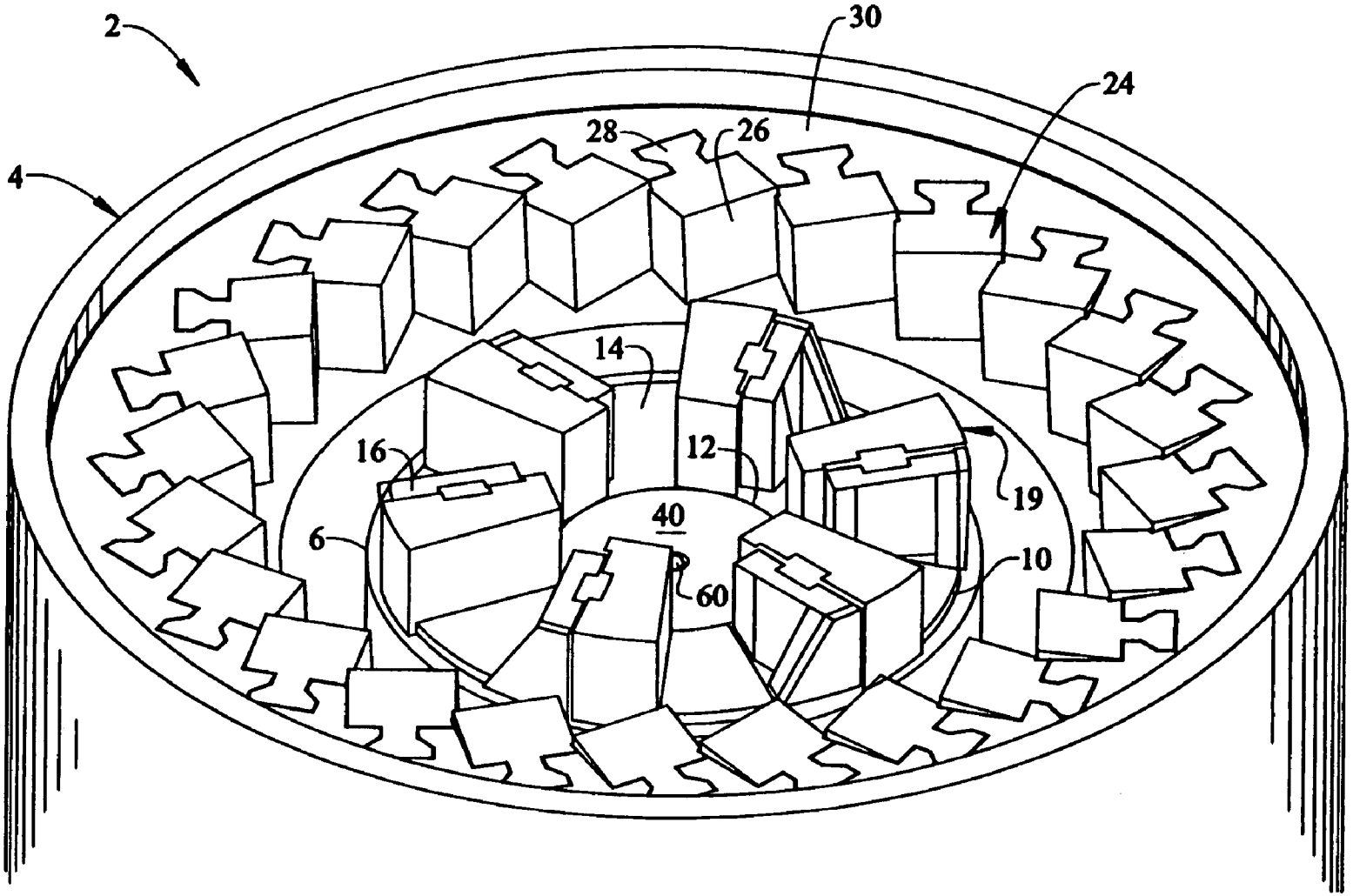
FIG. 1 is a partial, perspective view of a portion of a vertical shaft impact crusher.

With initial reference to FIG. 1, an impact crusher, employed to reduce a material flow of large earth materials to smaller sized aggregate particles, is generally indicated at 2. Impact crusher 2 includes a housing 4 within which is arranged an impeller table assembly 6. In accordance with a preferred form of the invention, impeller table assembly 6 includes an outer edge portion 10 and an inner 10 edge portion 12 that define an impeller surface 14. Arranged about impeller surface 14 are a plurality of impeller mounting brackets, one of which is indicated at 16, provided with a corresponding replaceable shoes 19. In addition, a plurality of fixed anvils 24 are arranged radially about impeller table assembly 6. As will be detailed more fully below, large earth materials are directed onto anvils 24 with a tremendous impact force such that the large earth materials disintegrate into smaller sized particles. Due to the violent forces applied to the fixed anvils 24, over time they tend to become worn and must be replaced. Therefore, each anvil 24 includes a face portion 26 that leads to a tail portion 28. As shown, tail portion 28 is formed so as to be slidingly received in an anvil ring 30 that is disposed about an inner periphery of housing 4.

In general, the above-described structure is provided for the sake of completeness and to enable a better understanding of the overall invention. One key aspect of the present invention is particularly directed to a center feed disk 40 located centrally witin impeller table assembly 6. In operation, center feed disk 40 is rotated together wit impeller table assembly 6. A flow of large earth materials is dropped onto center feed disk 40 and a tremendous centrifugal force, developed by rotating center feed disk 40, causes the flow of large earth materials to be deflected radially outwardly toward impeller shoes 16. Impeller shoes 16 catch the large earth materials and throw them violently against fixed anvils 24. When the large earth materials strike fixed anvils 24, the earth materials crack, under the force of their own momentum, into relatively uniform, often cubical pieces, that fall down onto a conveyor (not shown) or other suitable output device. Due to the extreme forces involved, center feed disk 40 must be formed from a wear-resistant material to provide an acceptable service life. In accordance with one form of the invention, the wear-resistant material is a metal alloy. A preferred metal alloy is a high chrome iron alloy having approximately 23–30% chromium (see ASTM A532/A532M - 93a (reapproved 1999)$^{\epsilon 1}$). In accordance with another form of the invention, center feed disk 40 is formed from carbide or other ceramic composite, preferably cemented tungsten carbide. Regardless of the particular material, center feed disk 40 must resist, as long as possible, the constant wear from large earth materials being fed into impact crusher 2.

Figure 2:
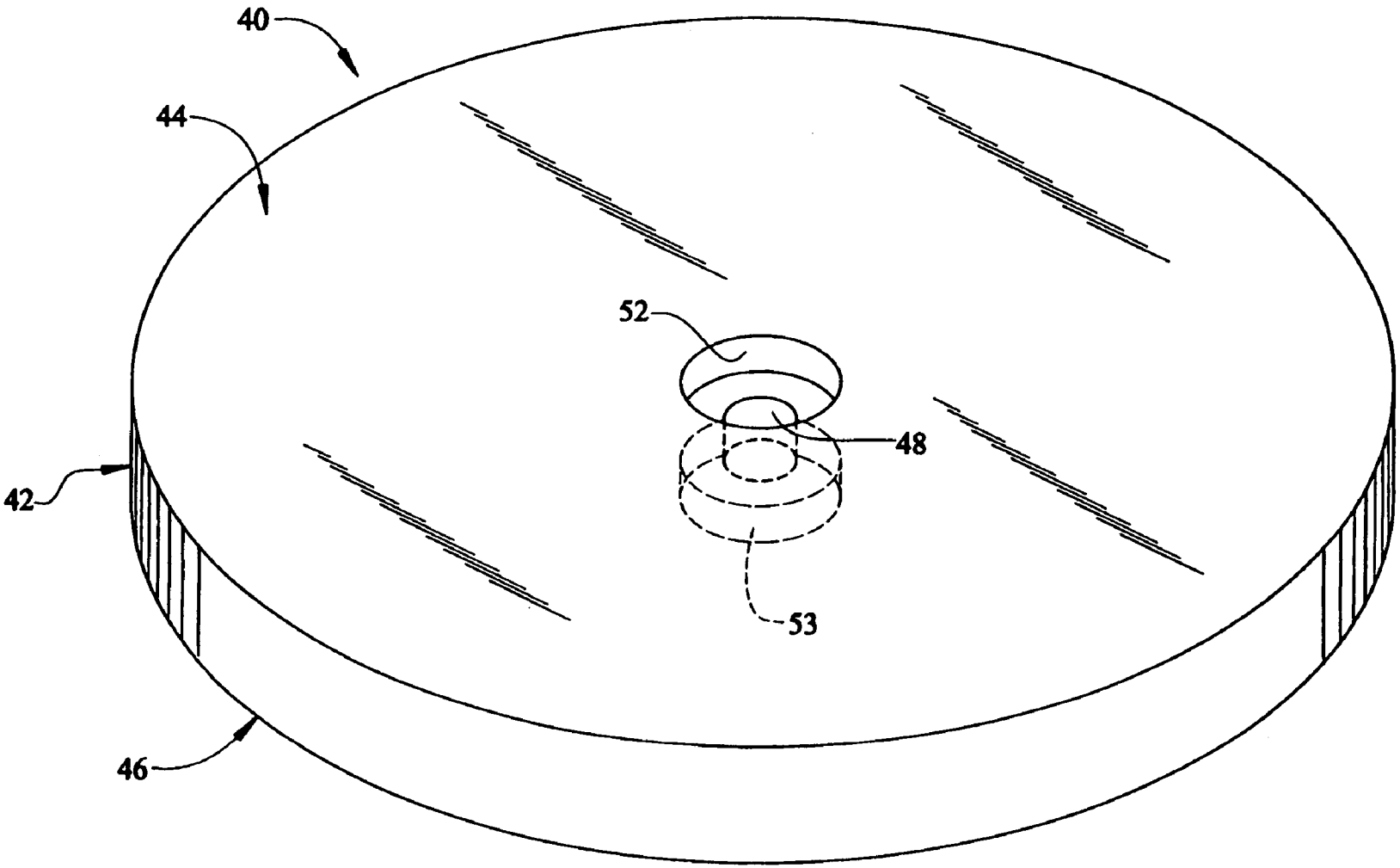
FIG. 2 is a perspective view of a center feed disk for the vertical axis impact crusher constructed in accordance with the present invention.

As best shown in FIG. 2, center feed disk 40 includes a peripheral edge 42, a first face 44 and an opposing, second face 46. In addition, center feed disk 40 is provided with a central bore 48 that extends through first and second faces 44 and 46. In accordance with the most preferred form of the invention, center feed disk 40 is provided with a first countersunk pocket 52 formed on first face 44 about central bore 48. In addition, a second countersunk pocket 53, is formed in second face 46, also about central bore 48. With this particular construction, after a significant amount of wear has developed on first face 44, center feed disk 40 can be inverted and re-mounted to impeller table assembly 6 to make use of second face 46. That is, the material flow dropping onto and shifting along center feed disk 40 causes notches, grooves, pits and other signs of wear to develop over time on first face 44. This wear, if left unchecked, could result in particles being deflected wildly about housing 4 resulting in an overall reduction in efficiency of impact crusher 2.

Figure 3:
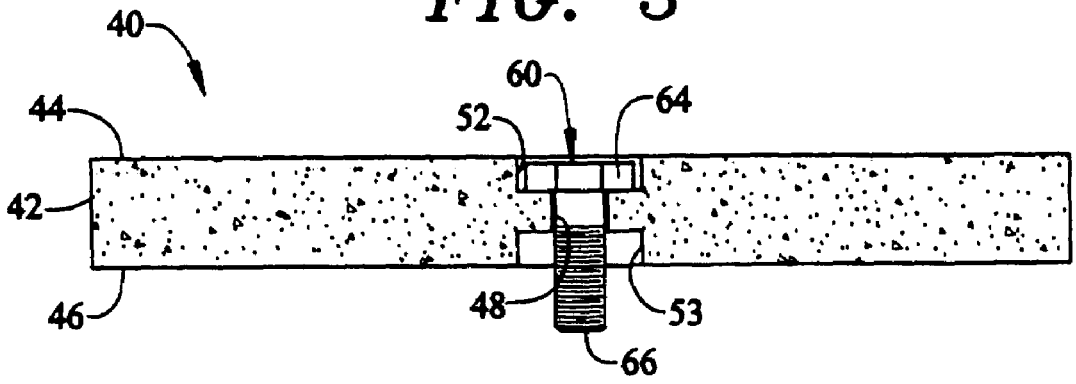
FIG. 3 is a cross-sectional side view of the center feed disk of FIG. 2 illustrating the exposure of a first face of the disk to a material flow.

As best represented in FIG. 3, center feed disk 40 is initially installed into impact crusher 2 with first face 44 being exposed to the flow of large earth materials. More specifically, center feed disk 40 is placed centrally within impeller table assembly 6 and secured to impeller surface 14 through a fastener 60. Fastener 60 is provided with a head 64 that is received within countersunk pocket 52 and a shaft 66 that extends through central bore 48 to secure center feed disk 40 for rotating with impeller table assembly 6. At this point, center feed disk 40 is rotated, together with impeller table assembly 6, causing the large earth materials to be guided radially outwardly onto impeller shoes 16 which hurl the large earth materials onto anvils 26 in the manner described above.

Figure 4:
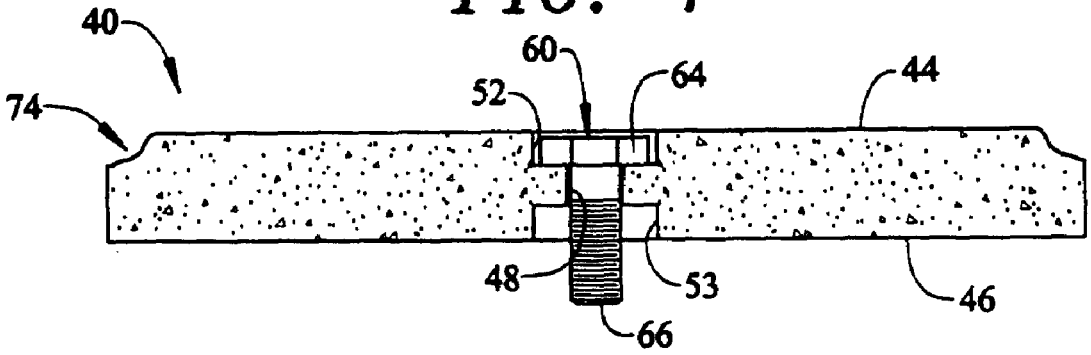
FIG. 4 is a cross-sectional side view of the center feed disk of FIG. 3 illustrating wear caused by repeated sliding wear of the material flow.

As indicated above, over time, wear begins to develop on first face 44, such as indicated by an annular notch 74 in FIG. 4. The presence of annular notch 74 can cause earth materials to be directed at angles that would not result in optimum impacts on either impeller shoes 16 or anvils 26, thus lowering the overall efficiency of impact crusher 2. To address this problem in accordance with the invention, once a substantial degree of wear has developed on first face 44, fastener 60 is removed, center feed disk 40 is indexed or inverted, and then feed disk 40 is remounted to impeller table assembly 6 with second face 46 exposed to the material flow. With this overall arrangement, the service life of center feed disk 40 can be increased by as much as two times, thereby reducing the overall cost of operating impact crusher 2.

In accordance with the most preferred form of the invention, prior to inverting and remounting of center feed disk 40, annular notch 74, as well as other imperfections (not shown) on first face 44, is filled with a resin, or preferably a high density material such as LAB/metal™, to smooth and improve the balance and level center feed disk 40. Because center feed disk 40 rotates at speeds upwards of 2000 RPM, the various imperfections, and particularly annular notch 74, in first face 44 can cause significant vibrations to impact crusher 2. Therefore, in order to smooth the surface of and improve the balance center feed disk 40, a resin material 78 is applied to first face 44 and allowed to harden to resurface first face 44. The resin material may contain a filler material such as aluminum, iron, lead, tungsten or tungsten carbide to further improve the balance of the disk.

Figure 5:
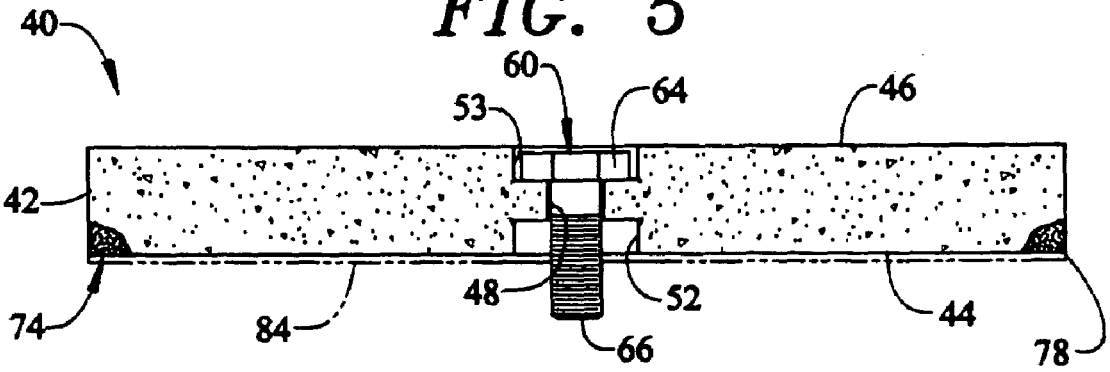
FIG. 5 is a cross-sectional side view of the center feed disk of FIG. 4 inverted to expose a second face of the disk to the material flow, with the wear zone on the first face being shown filled with a resin material.

Prior to remounting center feed disk 40 to impact crusher 2 with second face 46 exposed to the material, a spacer or shim 84 can be placed upon first face 44 as indicated in FIG. 5. In accordance with the most preferred embodiment, spacer 84 is made of steel. More specifically, it is important to ensure that the exposed face 44, 46 is maintained at a specified level above impeller surface 14. That is, if first or second face 44, 46 falls below the level of impeller surface 14, material can enter or collect at inner edge 12. Ultimately, this could wear away inner edge 12 and perhaps reach a drive mechanism of impact crusher 2. Thus, prior to remounting center feed disk 40, spacer 84 can be positioned to ensure that second face 46 is at the specified design height in related to the impeller surface 14. The remounting of center feed disk 40 is enhanced by incorporating symmetrical countersunk pockets 52 and 53 in faces 44 and 46 respectively. In any event, the overall service life of center feed disk 40 can be increased be inverting and remounting center feed disk 40 after wear has developed on first face 44. This ability reduces the costs, inconveniences, and lost work associated with disk replacement.

In one particular embodiment of the invention, a cemented tungsten carbide center feed disk 40 was utilized for crushing 120,000 tons of earth materials before being removed and inverted. When inverted, a steel spacer 84 was employed. In any event, it should be readily apparent that the combination of the materials used to make center feed disk 40 and the ability to invert center feed disk 40 in accordance with the invention results in a dramatic increase in the useful life of center feed disk 40. Correspondingly, the costs associated with operating impact crusher 2 and its related downtime are significantly reduced such that an extremely advantageous and commercially viable arrangement is established.

All documents, publications and patents referred to herein are hereby incorporated by reference.

Although described with reference to a preferred embodiment of the present invention, it should be readily apparent to one of ordinary skill in the art that various changes and/or modifications can be made to the invention without departing from the spirit thereof. For instance, it should be understood that the use of the terms first and second surfaces is for the sake of clarity and is not intended to limit the scope of the present invention. In general, the invention is only intended to be limited to the scope of the following claims.

What is claimed is:

1. An impact crusher comprising:

an impeller table assembly including an impeller table having an outer edge portion and an inner edge portion that define an impeller surface, and a plurality of shoes arranged about the impeller surface;

at least one anvil spaced from the outer edge portion of the impeller table;

a center feed disk including a peripheral edge portion, a first face, an opposing, second face, a central bore extending through the first and second faces, and first and second countersunk pockets provided about the central bore in the first and second faces respectively;

a fastener mounting the center feed disk radially inward of the inner edge portion of the impeller table with the first face being exposed, said fastener including a head recessed in the first countersunk pocket, and a shaft extending through the central bore wherein, after the first face develops a wear region resulting from material flow, said fastener can be removed, the center feed disk inverted, and then the center feed disk re-mounted with the second face being exposed, whereby an overall service life of the center feed disk is increased.

2. The impact crusher according to claim 1, wherein the center feed disk comprises a wear-resistant material.

3. The impact crusher according to claim 2, wherein the wear-resistant material comprises a chromium-iron alloy, ceramic composite or cemented carbide.

4. The impact crusher according to claim 3, wherein the chromium-iron alloy includes approximately 23–30% Chromium.

5. The impact crusher according to claim 2, wherein the wear-resistant material constitutes cemented carbide.

6. The impact crusher according to claim 5, wherein the wear-resistant material constitutes cemented tungsten carbide.

7. The impact crusher according to claim 1, wherein each of the first and second faces of the center feed disk are initially, substantially smooth.

8. A center feed disk for an impact crusher comprising:

a peripheral edge portion;

a first face defining a first impact surface;

an opposing, second face defining a second impact surface;

a central bore extending through the first and second faces; and first and second countersunk pockets provided about the central bore in the first and second faces respectively, wherein the center feed disk can be used in an impact crusher with the first face initially exposed and then the second face subsequently exposed.

9. The center feed disk according to claim 8, wherein the center feed disk is formed from a wear-resistant material.

10. The center feed disk according to claim 9, wherein the wear-resistant material constitutes a chromium-iron alloy.

11. The center feed disk according to claim 10, wherein the chromium-iron alloy includes approximately 23–30% Chromium.

12. The center feed disk according to claim 9, wherein the wear-resistant material constitutes carbide.

13. The center feed disk according to claim 12, wherein the wear-resistant material constitutes cemented tungsten carbide.

14. The center feed disk according to claim 8, wherein each of the first and second annular surfaces are substantially smooth.

* * * * *